US007150777B2

(12) United States Patent
Alcantara

(10) Patent No.: US 7,150,777 B2
(45) Date of Patent: Dec. 19, 2006

(54) METHOD FOR RECOVERY OF BY PRODUCT GAS IN VACUUM HEAT TREATMENT

(75) Inventor: Miguel Angel Alcantara, Querétaro Oro (MX)

(73) Assignee: Ciateq A.C., Queretaro (MX)

( * ) Notice: Subject to any disclaimer, the term of this patent is extended or adjusted under 35 U.S.C. 154(b) by 274 days.

(21) Appl. No.: 10/423,067

(22) Filed: Apr. 25, 2003

(65) Prior Publication Data

US 2004/0211296 A1 Oct. 28, 2004

(51) Int. Cl.
*C21C 7/10* (2006.01)
*C21B 13/00* (2006.01)

(52) U.S. Cl. ..... 75/508; 266/44; 266/144

(58) Field of Classification Search ..... 266/44, 266/144; 75/508
See application file for complete search history.

(56) References Cited

U.S. PATENT DOCUMENTS 4,326,867 A * 4/1982 Stokes ..... 62/601
5,368,067 A * 11/1994 Cook, Jr. ..... 137/485
6,217,633 B1 * 4/2001 Ohmi et al. ..... 95/8
6,851,316 B1 * 2/2005 Micke et al. ..... 73/40.7

* cited by examiner

*Primary Examiner*—Scott Kastler
(74) *Attorney, Agent, or Firm*—Carmen Pili Ekstrom

(57) ABSTRACT

A method and apparatus for the recovery of by product gases used in a vacuum metal treatment process or other gas treatments processes are disclosed. The present invention is normally carried out in a process chamber in the last stage of the process, after vacuum processing. The chamber is filled with an inert gas for cooling down the processed metal or other materials load at a certain predetermined pressure. The chamber is connected to a receiver having a pressure control device and a mechanism capable of changing its volume in order to keep constant pressure during the passage of gas from the chamber into the receiver. In addition, there is a cooling or heat transfer device to reduce the recovering gas temperature between the chamber and the receiver. The gas flow is driven by the excess pressure in the chamber during a first transfer period, or by the vacuum pumping system during the last gas transfer period. Once the gas is contained in the receiver, this is connected to an intake of a high performance compressor, which in time will accomplish the gas transfer from constant pressure to high pressure containers.

20 Claims, 2 Drawing Sheets

METHOD FOR RECOVERY OF BY PRODUCT GAS IN VACUUM HEAT TREATMENT

BACKGROUND OF THE INVENTION

Figure 1:
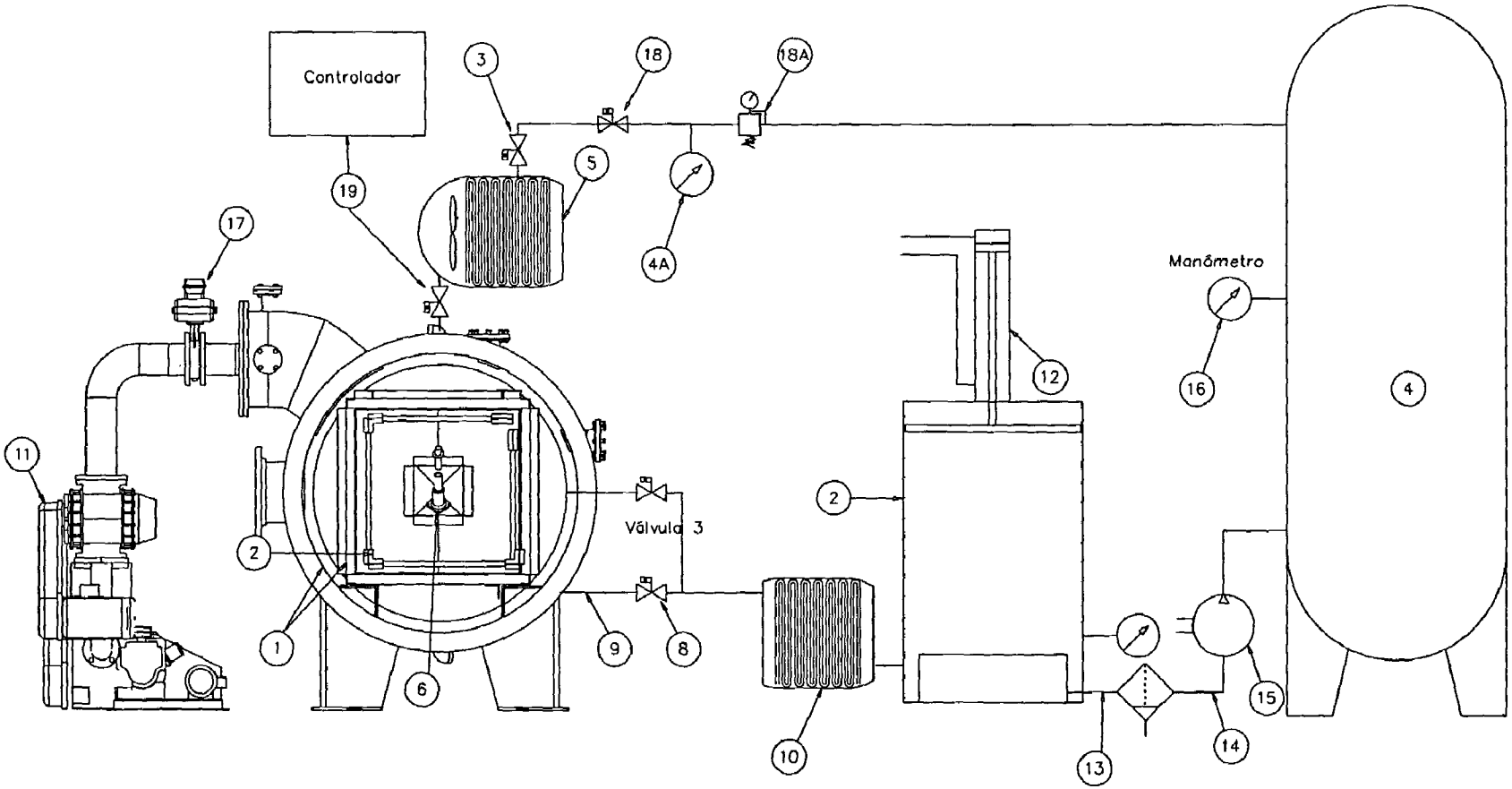

In the past, during the last segment of a typical vacuum heat treatment, different gases have been used to cool down or quench a metal load once such load was thermal processed in a vacuum chamber. Such cooling process is carried out by means of injection of said gases into the chamber to achieve certain pressure inside the chamber, where the load is thermally processed. Once the processed load reaches the desired final low temperature due to the heat removal by the injected gas, such quenching gas contained in the chamber is lost to the atmosphere. In practice, the gas is not recovered because to make it possible, the chamber containing the cooling or process gas should be evacuated from said chamber into a separate container in two conditions of the system: first condition is when the process chamber at the end or in the last stage of the process has a positive pressure, and the process chamber is connected to the receiving container so that the gas is driven by its positive pressure, and after the transfer of the gas is accomplished and both chambers reach equilibrium, the transfer of the gas should be continued and accomplished by means of a compressor, in which case could take a long and impractical period of time, or to operate a too high capacity compressor; a second condition is when the inside of the chamber ends the cooling process at atmospheric quenching gas pressure, or reaches atmospheric cooling gas pressure, then the transfer of the gas to the adjacent container might be accomplished by the vacuum pumping system, but that is not possible because the container should reach a higher than atmospheric pressure for to the accumulation of recovered and storage gas in said container. So the recovery of gases in the mentioned process, and in some other processes using for instance inert gases at a certain pressure and especially in vacuum processes, and that are economically attractive to recover, have not been carried out in practice due to the mentioned concepts and practical implications.

DESCRIPTION OF THE PREFFERED EMBODIMENT

The present invention describes a method for the recovery of gases used during a cooling stage or last stage of a thermal vacuum treatment, or during other treatments, by means of transferring the gas to be recovered from the chamber where gas is used for the process in to a receiver vessel that is kept at a constant pressure, always close to the atmospheric pressure. The receiver vessel is able to maintain this constant pressure by means of changing its volume. According to the gas flow entrance of the recovered gas into the receiving container; that is, the gas flow into the receiver is always correlated to the volume change of the receiver, by means of a control device that produces a change in volume of the receiver proportional to the flow of gas at constant pressure. So that, as the gas flows from the process chamber driven by the excess pressure within the chamber, or driven by the vacuum pumping system into the variable volume receiver, the constant pressure of said receiver, allows the gas to flow from the process chamber into the receiver. Because in any condition or pressure in the chamber, the gas will always "sees" such receiver at a constant atmospheric pressure at any moment during the gas recovery process. The gas flowing from the process chamber into the receiver might travel through a heat exchanger to reduce the temperature of the hot gas coming from the process chamber and arrive at ambient temperature when entering into the receiver, so that the receiver is not damaged by the hot gas exhaust from the relative high temperature of the chamber. When the gas is transferred from the process chamber into the variable volume/constant pressure container, such container, in receiving the recovering gas, may increase its volume up to the point that the pressure in the chamber reaches a desired high vacuum. That is, during the transfer gas process, the gas may be driven during a first period by the excess pressure in the chamber, and then, when the system (the chamber pressure) reaches equilibrium with the atmospheric pressure of the receiver, the vacuum pumping drives the transfer of the gas, evacuating the chamber up to a desired high vacuum level, so that most of the gas has been transferred into the receiver, leaving a vacuum stage or no gas to be recovered in the process chamber. Once the gas is contained in the receiver, which becomes a holding vessel for the following recovery process step, the receiver or holding container is connected through a large exhaust nipple and valve, into an intake of a high performance compressor, that takes or receives the gas at a constant atmospheric pressure, and therefore having no problem of intake high pressure differentials. The compressor then transfers the gas into a high pressure storage tank, leaving it ready to reutilization for a next treatment cycle.

For example, a complete gas recovery cycle in a typical vacuum heat treatment process might comprise the following steps and process parameters figures:

During the last stage in a typical vacuum treatment of an alloy steel, the highest temperature of a quenching treatment cycle is reached and maintained during 40 min to get uniform through temperature in the processed load. After such period of time, the heat flow from the chamber resistances that maintain a constant temperature of 980° C. in the steel load, is interrupted to allow the beginning of the quenching process by injecting inert gas to obtain, for example 2 bars in the chamber, and hit the steel pieces load to remove heat and reduce its temperature at a given cooling rate, depending on the configuration of the system, thermal capability of the quenching gas, flow rate, and the close circuit gas cooling system capacity of the furnace. The cooling gas in the chamber may be recirculated through the load in a close loop inside the system of the furnace. Once the load reaches, say 90° C., the cooling inert gas driven by its positive pressure, is allowed to flow by opening a valve, into the constant atmospheric pressure receiver, which in turn start to increase its volume to keep the constant pressure desired. Once the system reaches equilibrium and the chamber and receiver reaches the same pressure (atmospheric), the vacuum pumping system evacuates the chamber into the receiver which in turn holds the total gas to be recovered by leaving a high vacuum level in the process chamber. In this condition, a valve is closed to isolate the holding receiver vessel from the process chamber; then the chamber is alleviated to atmosphere, able to receive air into said chamber because of the now low temperature of the heating elements. Before the receiving holding container is filled with the recovered gas, the exhaust valve of 8 to 12 inch of said container, is opened to connect it to the intake of the compressor which in turn moves the gas into the storage tank above for example 50 psi , depending on the system characteristics (gas type and compressor capability). The gas in the storage tank, has certain level of oxygen contamination, due to the fact that the gas recovering is made from a system that has operated at a certain low pressure, say a good vacuum of 10 (−5) torr, still containing certain level of impurities, mainly oxygen. So when the gas is reused, the following cycles will contain more contaminants and so the number of cycles is limited by this concept, which in turn is determined to a certain extent, by the operating vacuum level in the furnace. The gas is then prepared to be reused in a next cycle when it is kept in the storage tank, as this is connected to the furnace system, and in time, the high pressure in the tank will drive the injection of the cooling gas into the chamber; for instance, the gas flow from the tank into the process chamber, may take place in a pressure range much below 50 psi so for example, a 600 cubic feet furnace chamber, a double volume in the storage high pressure (above 50 psi) tank, will contain enough gas to carry out a quenching process taking place at 2 bars inside the furnace. A variant to the inside recycling of the cooling gas might be the direct injection of the gas into the chamber and then directly allowed to exhaust to the receiver, as in any case it is to be recovered.

The limiting factor in this case is the total amount of gas to be used and the holding capacity of the receiver.

DETAILED DESCRIPTION OF THE INVENTION

The description of the concepts and functions for parts and components, are described in the following drawings within the preferred embodiment of this invention.

The general process is described in FIG. 1, where a vacuum furnace and interior chamber (1), ends the last step of heating in a typical heat treatment with the interruption of the energy provision to the heating elements (2) of said furnace, to then begin the quenching or fast cooling process by opening a valve (3) and allowing the quenching gas stored at high pressure in tank (4), to flow at certain controlled pressure (4A) into the furnace chamber (1); once the chamber is filled at a certain predetermined pressure with such gas, this gas usually circulates inside chamber (1), passing every cycle through a heat exchanger (5) to maintain the low temperature and quenching capacity of the gas. Once the load (6) in the furnace chamber (1) has reached the desired low temperature, the gas at positive pressure is allowed to flow to the receiver or holding gas container (17) at atmospheric pressure, by opening a valve (8) that connects the chamber (1) and receiver (7) and that is located in a pipe connection (9) before a possible heat exchanger (10) that reduces the gas temperature before reaching the receiver container; the gas continues to flow driven by the vacuum pumping system (11).

Figure 2:
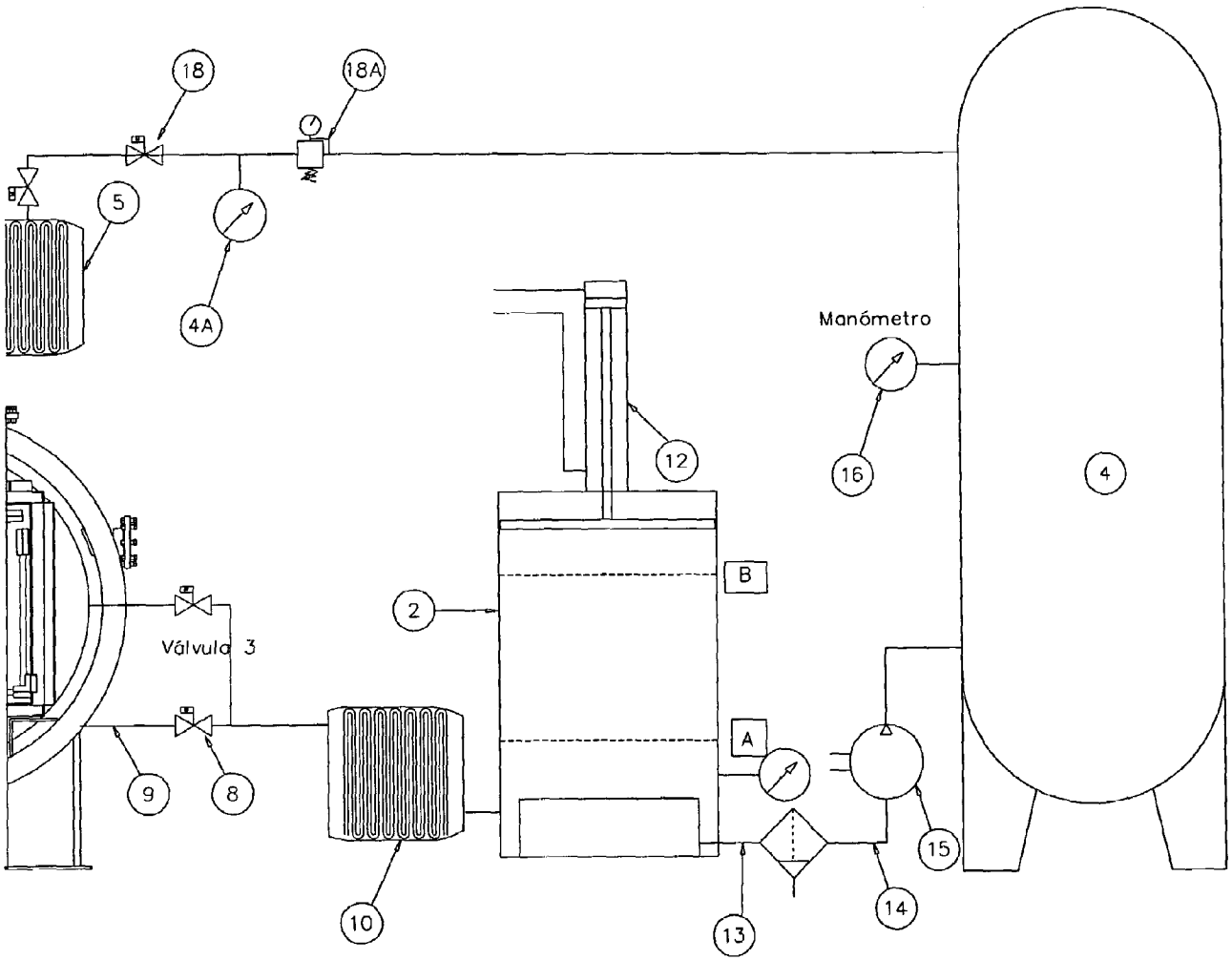

In FIG. 2, the receiver (7) is shown with more detail in its operation; when the gas is transferred from the chamber to the receiver that is kept at atmospheric pressure, the volume of this receiver increases as the gas flows, first when transferring the gas driven by the positive pressure of the gas in chamber (1), and then by the action, of the pumping vacuum system that continuously discharges into an atmospheric pressure system consisting of the receiver intake pipe (9). The receiver increases its volume from position -A- to position -B- as shown in FIG. 2; such volume change might be assisted by a driving controlled mechanism (12) that expands the variable volume container, been the maximum volume or maximum position of B, the one that corresponds to the condition of the total gas transferred into the holding receiver (7) and a high vacuum level in the furnace, for certain maximum previous operating pressure in the chamber (1).

Once the gas is in the process of been transferred from chamber (1) to the receiver container (7), and said receiver has started its expansion, say to point A as shown in FIG. 2, a holding receiver exhausts valve (13) might be opened to connect the receiver container with the intake port (14) of a filter and compressor (15) in order to start the transfer the recovered gas from the receiver (7) at constant atmospheric pressure, into the storage tank (4) at higher pressure as the compressor sucks the gas from receiver (7). Once the gas is contained in the storage tank, which pressure will depend on gas nature and equipment characteristics, it should be able to be used again in a next heat treatment cycle process, considering the proper instrumentation and control devices to be used for this purpose, as pressure gages (16), pressure switches to control (16) and on/off control valves (18) to allow the passage of gas through furnace feeding pipe (19) connecting high pressure storage tank, to process chamber (1) and to quench load (6) contained in said chamber (1); pressure gages (16), pressure switches (17) and valves (18) are connected to control system (19) in the furnace.

I claim:

1. A method for recovering by product gases in vacuum metal treatment process or other treatment processes comprising the steps of:

a) charging a load into a chamber;

b) introducing an inert gas into the chamber at a controlled pressure;

c) filling the chamber with the gas and circulating said gas inside the chamber;

d) flowing the gas to a receiver and maintaining said receiver at a constant pressure;

e) continuing the flow of gas into the receiver by a vacuum pump system;

f) transferring the gas at constant pressure from the receiver to a storage tank at a high pressure;

g) recovering the gas for reuse;

wherein the gas in step (c ) passes through a first heat exchanger at every cycle to maintain a low temperature of the gas and the load; and h) maintaining the constant pressure of the receiver by varying its volume and using a second heat exchanger which reduces the temperature of the gas before being fed into the receiver.

2. The method according to claim 1 wherein prior to introducing the inert gas in step (b), said gas is stored in a high pressure tank.

3. The method according to claim 1 wherein the pressure in step (d) is at atmospheric pressure.

4. The method according to claim 1 wherein a control device produces a change in volume of the receiver so that as the gas flows from the chamber driven by an excess pressure within the chamber or driven by vacuum pumping system into the receiver, the constant pressure of the receiver allows the gas to flow from the chamber into the receiver.

5. The method according to claim 1 wherein the receiver may increase its volume up to a point that the pressure in the chamber reaches a desired vacuum level.

6. The method according to claim 1 wherein the constant pressure is maintained by means of changing the volume according to the gas flow entry of the recovered gas into the receiver.

7. The method according to claim 6 wherein the change in volume in the receiver is proportional to the flow of gas at a constant pressure.

8. The method according to the claim 1 wherein in step (f), the gas may be driven during a first cycle by the excess pressure in the chamber and then when the chamber pressure reaches equilibrium with the atmospheric pressure of the receiver, the vacuum pumping system drives the transfer of gas, evacuating the chamber up to a desired high vacuum level.

9. The method according to claim 1 further comprising evacuating the chamber up to a desired high vacuum level so that most of the gas has been transferred into the receiver, leaving vacuum or no gas to be recovered in the chamber.

10. The method according to claim 9 wherein the vacuum level is about 10(−3) to about 10(−5) torr.

11. The method according to claim 1 further comprising the steps of:

a) connecting the receiver through a large exhaust nipple and valve into a high performance compressor which takes the gas at a constant atmospheric pressure; and b) transferring the gas into a high storage tank leaving it ready for the next treatment cycle.

12. The method according to claim 1 comprising recovering and recycling by-product gases at a controlled atmosphere during processes selected from the group consisting of: cooling stage of a vacuum heat treatment and atmospheric thermal process.

13. The method according claim 1, further comprising recovery of valuable gases at any pressure in the process.

14. The method according to claim 1, further comprising recovery of gas from a high vacuum level container in the last stage of gas recovery.

15. The method according to claim 1, further comprising recovering and storing at high pressure, a gas recovered from a system at any pressure and temperature including a container at high temperature and below atmospheric pressure.

16. The method according to claim 1, wherein the recovery of by-product gas is during the last stage in the vacuum treatment of an alloy steel, comprising the steps of:

a) charging a load into a chamber;

b) introducing an inert gas to obtain pressure above atmosphere in the chamber to begin the quenching process;

c) circulating the gas in the chamber through the load in a close loop inside the system such that the gas is driven by its positive pressure;

d) allowing the gas to flow into the receiver maintained at constant atmospheric pressure; said receiver increasing its volume to keep a desired constant pressure;

e) evacuating the chamber into the receiver when the system reaches equilibrium and the chamber and the receiver reaches the same atmospheric pressure;

f) holding the gas to be recovered in the receiver by leaving a high vacuum level in the chamber;

g) isolating the receiver from the process chamber;

h) alleviating the chamber to atmosphere to receive air into the chamber;

i) filling the receiver with the recovered gas;

j) opening an exhaust valve of the receiver prior to being completely filled with recovered gas;

k) connecting the receiver to an intake of a compressor which moves the gas into a storage tank.

17. The method according to claim 16, further comprising:

a) achieving and maintaining the highest temperature of the quenching process for a period of 40 minutes;

b) maintaining the heat flow from the chamber at a constant temperature of about 980° C. in the load;

c) reaching a load temperature of about 90° C. when the gas is driven by its positive pressure; and d) moving the gas into the storage tank at about 50 psi.

18. The method according to claim 1 employed in vacuum metal treatment process.

19. The method according to claim 12 further comprising recovering and recycling by-product gases at a controlled atmosphere during cooling stage of a vacuum heat treatment.

20. The method according to claim 12 further comprising recovering and recycling by-product gases at a controlled atmosphere during atmospheric thermal process.

* * * * *